United States Patent [19]

Tanaka et al.

[11] Patent Number: 5,062,901

[45] Date of Patent: Nov. 5, 1991

[54] METHOD OF PRODUCING HARDENED ALUMINUM ALLOY SHEETS HAVING SUPERIOR CORROSION RESISTANCE

[75] Inventors: Hiroki Tanaka; Shin Tsuchida, both of Nagoya, Japan

[73] Assignee: Sumitomo Light Metal Industries, Ltd., Tokyo, Japan

[21] Appl. No.: 524,295

[22] Filed: May 15, 1990

[30] Foreign Application Priority Data

Aug. 25, 1989 [JP] Japan ..... 1-217479

[51] Int. Cl.[5] ..... C21D 8/00; C22C 21/06

[52] U.S. Cl. ..... 148/11.5 A; 148/12.7 A; 148/159; 148/417; 148/439; 420/533

[58] Field of Search ..... 148/11.5 A, 159, 417, 148/439, 12.7 A; 420/533

[56] References Cited

U.S. PATENT DOCUMENTS 4,707,195 11/1987 Tsuchida et al. ..... 148/11.5 A 4,968,356 11/1990 Tanaka et al. ..... 148/11.5 A

FOREIGN PATENT DOCUMENTS 57-120648 7/1982 Japan ..... 148/439

*Primary Examiner*—R. Dean

*Assistant Examiner*—Robert R. Koehler

*Attorney, Agent, or Firm*—Flynn, Thiel, Boutell & Tanis

[57] ABSTRACT

The present invention provides a method of producing a hardened aluminum alloy sheet comprising the steps of casting an aluminum alloy containing 4.0 to 6.0% Mg in a conventional including, homogenizing, hot rolling, cold rolling, intermediate annealing and stabilizing treatment, the improvement which comprises: the aluminum alloy is provided as an Al-Mg-Cu alloy containing, in addition to Mg, 0.05 to 0.50% Cu; and the Al-Mg-Cu alloy is subjected to a final intermediate annealing treatment comprising a heating to temperatures of 350° to 500° C. and rapid cooling to temperatures of 70° C. or less at a cooling rate of 1° C./sec or more and a finishing cold rolling with a reduction of at least 50%, followed by the stabilizing treatment, thereby providing a hardened aluminum alloy sheet having a superior corrosion resistance together with high levels of strength and formability. In the above production method, the finishing cold rolling with a reduction of at least 50% may be followed by coating and baking operations carried out under application of tension to the alloy.

2 Claims, 2 Drawing Sheets

METHOD OF PRODUCING HARDENED ALUMINUM ALLOY SHEETS HAVING SUPERIOR CORROSION RESISTANCE

BACKGROUND OF THE INVENTION

1. Field of the Invention

The present invention relates to a method of producing hardened Al-Mg alloy sheets and coated hardened aluminum alloy sheets which have high levels of strength and formability and which have been used in easy-open can ends or the like.

More particularly, the present invention is directed to a method of producing hardened aluminum alloy sheets which are significantly improved in both resistance to intergranular corrosion (pitting corrosion) and bend ductility together with having a combination of high strength and good formability.

2. Description of the Prior Art

Conventionally, in making easy-open type can ends, there have been employed work-hardened sheets fabricated from aluminum alloys including Mg as a primary alloying element e.g., AA 5082, AA 5182 or the like, in which cold rolling has been practiced to obtain an increased strength and, further, baking of a corrosion-resistant coating applied onto the sheets. The conventional work-hardened sheets used in such applications contain Mn, Zr and V in orer to compensate for the strength loss caused due to the coating and baking operations. (Japanese Patent Publication No. 57-33332). Further, there is also proposed another fabrication process in which the sheets are hot rolled and, if desired, cold rolled. Thereafter, the sheets are subjected to an intermediate annealing at temperatures of 300° to 400° C. and a cold rolling to impart an increased strength to the resulting work-hardened sheets. During the coating and baking operations, distortion occurs due to the residual strain in the sheets, thereby presenting serious problems in subsequent operations. A method to relieve such residual stress is proposed in Japanese Patent Publication No. 57-11384 in which heat treatment (stabilizing treatment) is conducted at temperatures of 250° C. or less after a finishing cold rolling.

However, in recent years, there have been a increasing demand for thinner can stock and contents in cans have been more corrosive. In response to the demand for thinner can stock, can stock has been strengthened by increasing the addition of Mg or increasing the reduction amount in the finishing cold rolling step, as set forth above. However, these methods result in a reduced corrosion resistance. Further, the increasing corrosive properties of the contents may cause pitting corrosion and it has been found that even if the can stock is subjected to a stabilizing treatment, in addition to the above treatments, there is still the probability of similar problems. Apparently, in known materials, improvements in the alloys strength and formability adversely affect its corrosion resistance and there has been a problem of how to improve corrosion resistance. Further, an excessive reduction in the amount of finishing cold rolling will lower forming characteristics, such as deep-drawing characteristic (erichsen value) and bend ductility. In some cases, an easy-open pull tab or ring pull attached onto a can end is repeatedly bent or pulled to open the can end, for example, of a juice can. Such an occurrence is not usual but, for example, children try to open cans in such a manner and break the pull tab or ring pull from the repeatedly bent portion before opening the can.

It is therefore an object of the present invention to provide a method of producing hardened aluminum alloy sheets in which their corrosion resistance is significantly improved without lowering their strength and formability.

It has been known from previous studies that Mg, as a strengthening element, bonds to Al to form a compound ($\beta$-phase $Al_8Mg_5$) which is electrochemically less noble than the matrix. Particularly, when the $\beta$-phase is preferentially precipitated along grain boundaries in a can end material, intergranular corrosion proceeds due to the difference in pitting potential between this phase and the matrix, and, thereby, contents within a can will leak. In view of such a problem, conventional can end materials have been investigated and, as a result, it has been confirmed that the above detrimental precipitation preferentially occurs not only along recrystallized grain boundaries formed during the intermediate annealing, but also along grain boundaries during the final stabilizing treatment, thereby lowering the corrosion resistance of the resulting alloy materials. Attempts have been made to overcome such a problem. In order to increase the strength of can materials, addition of Mg has been increased or finishing cold rolling has been effected with a large amount of reduction. However, such a conventional manner is undesirable from the point of corrosion resistance, because it may induce the intergranular corrosion problem.

SUMMARY OF THE INVENTION

In order to overcome the above-mentioned problem, the present invention provides a method of producing a hardened aluminum alloy sheet comprising the steps of casting an aluminum alloy containing 4.0 to 6.0% Mg in a conventional manner and homogenizing, hot rolling, cold rolling, intermediate annealing and stabilizing treatment, the improvement which comprises: the aluminum alloy is provided as an Al-Mg-Cu alloy containing 0.05 to 0.50% Cu, in addition to Mg; and the Al-Mg-Cu alloy is subjected to a finishing intermediate annealing step comprising heating to temperatures of 350° to 500° C., rapid cooling to temperatures of 70° C. or less at a cooling rate of 1° C./sec or more and then a finishing cold rolling with a reduction of at least 50%, followed by the stabilizing treatment, thereby providing a hardened aluminum alloy sheet having a superior corrosion resistance. In the above-mentioned production method, coating and baking operations may be carried out under application of tension after the finishing cold rolling with a reduction of at least 50%.

In the specification, the compositions are all indicated by weight percent, unless specified otherwise.

DETAILED DESCRIPTION OF THE PREFERRED EMBODIMENTS

Figure 1:
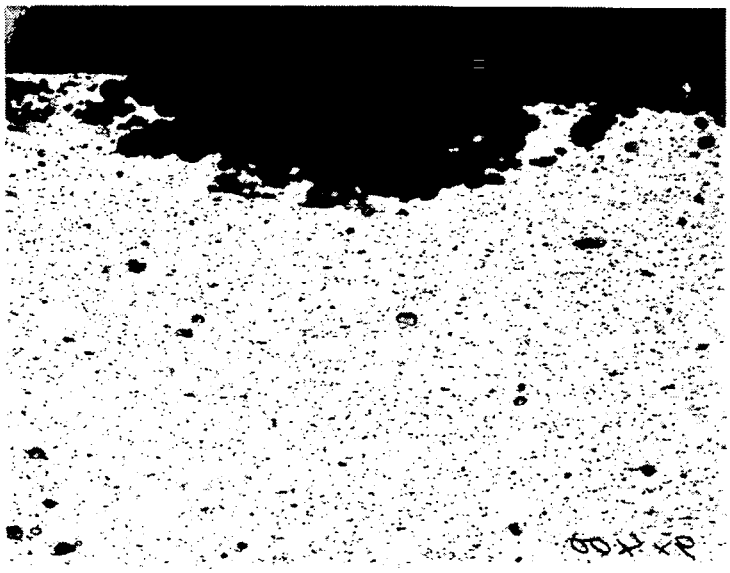
FIGS. 1 is a microphotograph showing the microstructure of a specimen of the present invention which has been subjected to a corrosion resistance test.

The reasons for limitations of the alloying elements and the processing conditions will be discussed in detail hereinbelow.

Mg is added to ensure a strength level required for can end materials. Addition of Mg of less than 4% can not provide the desired strength level, while addition of Mg exceeding 6% results in an inferior hot-workability.

Cu has the effect of improving the strength of the can materials and serves to suppress the alloys precipitation of Mg compounds ($\beta$-phase) along grain boundaries which may be caused during the intermediate annealing step and coolin in the stabilizing treatment step, thereby reducing the alloys susceptibility to intergranular corrosion. When the content of Cu is less than 0.05%, this effect is not sufficient. A Cu content exceeding 0.50% will result in an inferior formability.

In addition to the above alloying elements, the following elements may be present in order to improve the strength and corrosion resistance properties.

Ti has an effect in refining the crystal grains of the cast structure, thereby imparting a good formability to the resulting materials. When the content of Ti is less than 0.01%, the grain refining effect can not be sufficiently obtained. On the other hand, an excessive amount of Ti exceeding 0.05% will cause formation of coarse crystallization, thereby resulting in an inferior formability.

Mn has an effect in refining the crystal grains of the resulting materials, thereby improving the strength of the materials. Such strengthened materials can fully withstand stress which is changeable depending on the contents within a can. Mn compound precipitates in the matrix serve as sites for the precipitation of $\beta$-phase during intermediate annealing and stabilizing treatments and have the effect of reducing a local corrosion like intergranular corrosion. If the Mn content is less than 0.10%, the grain refining effect is insufficient. If the Mn content is more than 1.0%, the plastic working properties deteriorate.

Cr has effects similar to those of Mn and may be contained singly or in combination with Mn. If the Cr content is less than 0.10%, the effects can not be sufficiently obtained. If the Cr content exceeds 0.25%, coarse intermetallic compounds are formed and the alloys formability will deteriorate.

V, Ni and Zr are effective to increase the alloy's annealing temperature without impairing its corrosion resistance and reduce a loss in strength which may caused during the stabilizing treatment.

As other impurities, up to 0.40% Si, up to 0.50% Fe, up to 0.10% Zr and up to 0.005% B are tolerable because such content levels of these impurities do not adversely affect the alloys formability and corrosion resistance.

The reasons for the limitations of the processing conditions are set forth below.

Intermediate Annealing:

Intermediate annealing should be effected at temperatures of 350° to 500° C. in order to recrystallize a structure imparted by plastic working operations carried out prior to intermediate annealing. When the annealing temperature is less than 350° C., recrystallization is insufficient. An annealing temperature exceeding 500° C. is undesirable for processability and formability because melting of eutectic compounds occurs. In achieving the reduction of the alloys susceptibility to intergranular corrosion which is one of the objects of the present invention, it is desirable to prevent $\beta$-phase compounds less noble than the matrix from precipitating along grain boundaries. Therefore, cool during the intermediate annealing step should be carried out at a rapid cooling rate of 1° C./sec or more and the end temperature of the cooling should be 70° C. or less. Further, in order to obtain a grain refining effect, a heating rate to temperatures of 350° to 500° C. is preferably 2° C./sec or greater. The holding time at the temperatures is preferably within a period of 10 minutes to prevent the formation of coarse recrystallized grains which adversely affect formability.

Finishing Cold Rolling:

The reduction of the finishing cold rolling should be at least 50% in order to ensure the strength required for can end materials. However, a large degree of reduction exceeding 85% will lead to an unacceptable reduction of formability even if a stabilizing treatment is effected. Further, the pitting potential of the material becomes more base and its corrosion resistance will be unfavorably lowered.

STABILIZING TREATMENT

Stabilizing treatment is preferably performed at temperatures of 100° to 300° C. in order to improve the alloy's corrosion resistance and forming characteristics and remove its residual stress. This treatment may be carried out either in a continuous annealing furnace or in a batch furnace.

COATING AND BAKING

In cases where coating and baking operations are carried out without the above stabilizing treatment, a coating is applied onto the surface of a can material using a roll coater, or similar coating means, and then is baked at temperatures of 150° to 300° C. in a continuous annealing furnace. In the coating and baking operations, a tension of about 1 kgf/mm$^2$ or greater is applied in order to prevent distortion of the material. The baking temperature is determined depending primarily upon the kind of the paint used.

EXAMPLE 1

Ingots having the alloy compositions shown in Table 1 below were homogenized at 500° C. for a period of 8 hours, hot rolled at a starting temperature of 480° C. and cold rolled to provide sheets having a thickness of 0.5 to 1.5 mm. The sheets were subjected to intermediate annealing, finishing cold rolling and stabilizing treatments, under the processing conditions set forth in Table 2.

TABLE 1

| Alloy No. | Alloy Compositions (by weight %) | | | | | | | | | | |
|---|---|---|---|---|---|---|---|---|---|---|---|
| | Mg | Cu | Mn | Si | Fe | Cr | V | Ni | Zr | Ti | Al |
| 1 | 4.70 | 0.12 | 0.46 | 0.15 | 0.23 | — | — | — | — | 0.02 | Bal |
| 2 | 4.72 | 0.06 | 0.44 | 0.13 | 0.25 | 0.02 | 0.006 | 0.009 | 0.05 | 0.02 | Bal |

TABLE 1-continued

| Alloy No. | Alloy Compositions (by weight %) | | | | | | | | | | |
|---|---|---|---|---|---|---|---|---|---|---|---|
| | Mg | Cu | Mn | Si | Fe | Cr | V | Ni | Zr | Ti | Al |
| 3 | 4.2 | 0.41 | — | 0.16 | 0.28 | 0.10 | 0.003 | 0.010 | 0.05 | 0.02 | Bal |
| 4 | 4.80 | 0.02 | 0.46 | 0.09 | 0.15 | — | — | — | — | 0.02 | Bal |
| 5 | 3.2 | 0.15 | 0.49 | 0.13 | 0.21 | 0.12 | — | 0.009 | — | 0.02 | Bal |

Note:
Alloy Nos. 1 to 3: Examples of the present invention
Alloy Nos. 4 and 5: Comparative Examples

TABLE 2

| Specimen No. | 1 | 2 | 3 | 4 | 5 | 6 | 7 | 8 | 9 | 10 |
|---|---|---|---|---|---|---|---|---|---|---|
| Alloy No. | 1 | 1 | 1 | 1 | 1 | 1 | 1 | 1 | 1 | 1 |
| Intermediate annealing | | | | | | | | | | |
| Heating rate (°C./sec) | 2 | 2 | 2 | 2 | 2 | 2 | 2 | 2 | 2 | 2 |
| Temp. (°C.) | 450 | 350 | 500 | 400 | 450 | 450 | 450 | 450 | 450 | 450 |
| Holding time (sec) | 30 | 30 | 30 | 30 | 30 | 30 | 30 | 30 | 30 | 30 |
| Cooling rate (°C./sec) | 40 | 40 | 40 | 40 | 30 | 100 | 40 | 40 | 40 | 40 |
| Cooling temp. (°C.) | 60 | 60 | 60 | 60 | 60 | 60 | 50 | 70 | 70 | 70 |
| Reduction*1 (%) | 65 | 65 | 65 | 65 | 65 | 80 | 50 | 65 | 65 | 65 |
| Sabilizing treatment | | | | | | | | | | |
| Heating rate (°C./sec) | 10 | 10 | 10 | 10 | 10 | 10 | 10 | 10 | 10 | 10 |
| Temp. (°C.) | 250 | 250 | 250 | 250 | 250 | 250 | 250 | 250 | 200 | 300 |
| Holding time (sec) | 0.33 | 0.33 | 0.33 | 0.33 | 0.33 | 0.33 | 0.33 | 0.33 | 0.33 | 0.33 |
| Cooling rate (°C./sec) | 50 | 50 | 50 | 50 | 50 | 50 | 50 | 50 | 50 | 50 |
| Cooling temp. (°C.) | 70 | 70 | 70 | 70 | 70 | 70 | 70 | 70 | 70 | 70 |
| Mechanical properties | | | | | | | | | | |
| Tensile strength (kgf/mm$^2$) | 38.3 | 38.9 | 38.3 | 38.3 | 38.3 | 39.8 | 36.1 | 38.2 | 39.8 | 36.1 |
| Yield strength (kgf/mm$^2$) | 31.2 | 31.6 | 31.1 | 31.3 | 31.2 | 33.4 | 28.2 | 31.2 | 33.2 | 28.2 |
| Elongation (%) | 10 | 9 | 10 | 10 | 10 | 8 | 11 | 10 | 8 | 11 |
| Earing percentage 45° - 4 directions (%) | 3.5 | 3.5 | 3.5 | 3.5 | 3.5 | 5.9 | 3.3 | 3.5 | 3.5 | 3.5 |
| Bend ductility*2 | 16.9 | 16.9 | 17.1 | 16.9 | 16.9 | 15.9 | 17.4 | 16.9 | 16.5 | 17.3 |
| Pitting potential mV vs SCE | | | | | | | | | | |
| Ep | −670 | −670 | −670 | −670 | −670 | −673 | −669 | −670 | −671 | −667 |
| E'p | −673 | −674 | −673 | −673 | −673 | −678 | −672 | −673 | −674 | −670 |
| Δ Ep | 3 | 4 | 3 | 3 | 3 | 5 | 3 | 3 | 3 | 3 |

| Specimen No. | 11 | 12 | 13 | 14 | 15 | 16 | 17 | 18 | 19 | 20 |
|---|---|---|---|---|---|---|---|---|---|---|
| Alloy No. | 1 | 2 | 2 | 2 | 2 | 2 | 2 | 2 | 2 | 2 |
| Intermediate annealing | | | | | | | | | | |
| Heating rate (°C./sec) | 2 | 2 | 2 | 2 | 2 | 2 | 2 | 2 | 2 | 2 |
| Temp. (°C.) | 450 | 450 | 350 | 500 | 400 | 450 | 450 | 450 | 500 | 450 |
| Holding time (sec) | 30 | 30 | 30 | 30 | 30 | 30 | 30 | 30 | 30 | 30 |
| Cooling rate (°C./sec) | 40 | 40 | 40 | 40 | 40 | 100 | 40 | 40 | 40 | 40 |
| Cooling temp. (°C.) | 70 | 60 | 60 | 60 | 60 | 60 | 60 | 60 | 60 | 50 |
| Reduction *1 (%) | 65 | 65 | 65 | 65 | 65 | 80 | 65 | 65 | 65 | 50 |
| Sabilizing treatment | | | | | | | | | | |
| Heating rate (°C./sec) | 0.011 | 10 | 10 | 10 | 10 | 10 | 10 | 10 | 10 | 10 |
| Temp. (°C.) | 150 | 250 | 250 | 250 | 250 | 250 | 300 | 250 | 250 | 250 |
| Holding time (sec) | 7200 | 0.33 | 0.33 | 0.33 | 0.33 | 0.33 | 0.33 | 0.33 | 0.33 | 0.33 |
| Cooling rate (°C./sec) | 0.011 | 50 | 50 | 50 | 50 | 50 | 50 | 50 | 50 | 50 |
| Cooling temp. (°C.) | 60 | 70 | 70 | 70 | 70 | 70 | 70 | 70 | 70 | 70 |
| Mechanical properties | | | | | | | | | | |
| Tensile strength (kgf/mm$^2$) | 40.5 | 38.1 | 38.6 | 38.0 | 38.1 | 39.6 | 36.1 | 38.7 | 38.9 | 36.5 |
| Yield strength (kgf/mm$^2$) | 33.4 | 30.9 | 31.3 | 30.9 | 30.9 | 33.2 | 28.0 | 32.1 | 32.0 | 29.3 |
| Elongation (%) | 10 | 10 | 9 | 10 | 10 | 8 | 11 | 10 | 9 | 11 |
| Earing percentage 45° - 4 directions (%) | 3.6 | 3.5 | 3.5 | 3.4 | 3.5 | 5.8 | 3.5 | 3.5 | 3.5 | 3.2 |
| Bend ductility*2 | 15.1 | 16.7 | 16.6 | 16.8 | 16.7 | 15.7 | 17.0 | 16.7 | 16.7 | 17.1 |
| Pitting potential mV vs SCE | | | | | | | | | | |
| Ep | −684 | −672 | −673 | −672 | −672 | −677 | −669 | −662 | −661 | −660 |
| E'p | −692 | −676 | −677 | −675 | −676 | −683 | −676 | −665 | −664 | −663 |

TABLE 2-continued

| Δ Ep | 8 | 4 | 4 | 3 | 4 | 6 | 7 | 3 | 3 | 3 |
|---|---|---|---|---|---|---|---|---|---|---|
| Specimen No. | 21 | 22 | 23 | 24 | 25 | 26 | 27 | 28 | 29 | 30 |
| Alloy No. | 1 | 1 | 1 | 1 | 1 | 1 | 4 | 4 | 4 | 4 |
| Intermediate annealing | | | | | | | | | | |
| Heating rate (°C./sec) | 2 | 2 | 0.011 | 0.011 | 2 | 2 | 2 | 2 | 2 | 2 |
| Temp (°C.) | 300 | 450 | 350 | 350 | 450 | 450 | 450 | 350 | 400 | 500 |
| Holding time (sec) | 30 | 30 | 7200 | 7200 | 30 | 30 | 30 | 30 | 30 | 30 |
| Cooling rate (°C./sec) | 40 | 0.1 | 0.011 | 0.011 | 40 | 40 | 40 | 40 | 40 | 40 |
| Cooling temp. (°C.) | 50 | 60 | 60 | 60 | 60 | 120 | 60 | 60 | 60 | 60 |
| Reduction*1 (%) | 50 | 65 | 65 | 65 | 40 | 65 | 65 | 65 | 65 | 65 |
| Sabilizing treatment | | | | | | | | | | |
| Heating rate (°C./sec) | 0.11 | 0.11 | 1 | 0.011 | 10 | 10 | 10 | 10 | 10 | 10 |
| Temp. (°C.) | 150 | 150 | 150 | 150 | 250 | 250 | 250 | 250 | 250 | 250 |
| Holding time (sec) | 7200 | 7200 | 7200 | 7200 | 0.33 | 0.33 | 0.33 | 0.33 | 0.33 | 0.33 |
| Cooling rate (°C./sec) | 0.011 | 0.011 | 1 | 0.011 | 50 | 50 | 50 | 50 | 50 | 50 |
| Cooling temp. (°C.) | 60 | 60 | 50 | 50 | 60 | 60 | 70 | 70 | 70 | 70 |
| Mechanical properties | | | | | | | | | | |
| Tensile strength ($kgf/mm^2$) | 44.0 | 37.4 | 37.8 | 39.4 | 34.1 | 37.6 | 37.6 | 38.1 | 37.6 | 37.7 |
| Yield strength ($kgf/mm^2$) | 42.9 | 30.5 | 30.0 | 32.2 | 26.0 | 30.5 | 30.6 | 31.0 | 30.4 | 30.6 |
| Elongation (%) | 3 | 10 | 9 | 9 | 11 | 10 | 10 | 10 | 10 | 10 |
| Earing percentage 45° - 4 directions (%) | 7 | 3.5 | 3.6 | 3.6 | 3.2 | 3.5 | 3.5 | 3.5 | 3.5 | 3.5 |
| Bend ductility*2 | 12.5 | 15.1 | 15.1 | 13.9 | 17.6 | 17.4 | 14.7 | 14.7 | 14.7 | 14.8 |
| Pitting potential mV vs SCE | | | | | | | | | | |
| Ep | −684 | −680 | −682 | −710 | −668 | −675 | −673 | −673 | −673 | −673 |
| E'p | −693 | −692 | −696 | −725 | −671 | −688 | −682 | −682 | −682 | −682 |
| Δ Ep | 9 | 12 | 14 | 15 | 3 | 13 | 9 | 9 | 9 | 9 |

| | 31 | 32 | 33 | 34 | 35 | 36 |
|---|---|---|---|---|---|---|
| Specimen No. | 31 | 32 | 33 | 34 | 35 | 36 |
| Alloy No. | 4 | 4 | 4 | 5 | 4 | 4 |
| Intermediate annealing | | | | | | |
| Heating rate (°C./sec) | 2 | 2 | 2 | 2 | 2 | 2 |
| Temp. (°C.) | 450 | 450 | 450 | 450 | 500 | 450 |
| Holding time (sec) | 30 | 30 | 30 | 30 | 30 | 30 |
| Cooling rate (°C./sec) | 100 | 40 | 40 | 40 | 40 | 40 |
| Cooling temp. (°C.) | 60 | 60 | 60 | 60 | 60 | 50 |
| Reduction*1 % | 80 | 65 | 65 | 65 | 65 | 50 |
| Sabilizing treatment | | | | | | |
| Heating rate (°C./sec) | 10 | 0.011 | 0.011 | 10 | 10 | 10 |
| Temp. (°C.) | 250 | 250 | 150 | 250 | 250 | 250 |
| Holding time (sec) | 0.33 | 7200 | 7200 | 0.33 | 0.33 | 0.33 |
| Cooling rate (°C./sec) | 50 | 0.011 | 0.011 | 50 | 50 | 50 |
| Cooling temp. (°C.) | 70 | 60 | 60 | 70 | 70 | 70 |
| Mechanical properties | | | | | | |
| Tensile strength ($kgf/mm^2$) | 39.1 | 37.9 | 38.9 | 32.8 | 32.9 | 30.6 |
| Yield strength ($kgf/mm^2$) | 32.7 | 30.8 | 31.9 | 27.0 | 27.2 | 24.1 |
| Elongation (%) | 8 | 10 | 10 | 10 | 10 | 12 |
| Earing percentage 45° - 4 directions (%) | 5.9 | 3.6 | 3.5 | 3.4 | 3.4 | 3.2 |
| Bend ductility*2 | 13.5 | 14.2 | 14.0 | 16.9 | 16.9 | 17.4 |
| Pitting potential mV vs SCE | | | | | | |
| Ep | −673 | −689 | −689 | −666 | −665 | −662 |
| E'p | −683 | −700 | −701 | −669 | −668 | −665 |
| Δ Ep | 10 | 11 | 12 | 3 | 3 | 3 |

In Table 2;
*1: Reduction amounts of finishing cold rolling,
*2: Number of bending cycles until rupture occurred
Specimen Nos. 1-20: Examples of the present invention
Specimen Nos. 21-36: Comparative Examples Corrosion resistance was evaluated by measuring the pitting potentials of uncoated test specimens. For the pitting potential measurements, each test specimen was etched in a 10% aqueous solution of NaOH at 60° C. for 30 seconds, rinsed with water, neutralized in a 30% aqueous solution of $HNO_3$ at room temperature for 60 seconds and rinsed with water. Degassing was carried out for a period of at least one hour by bubbling an Ar gas into a 0.1 M-NaCl aqueous solution (pH=3.0) and each test specimen was immersed in the NaCl solution.

Figure 3:
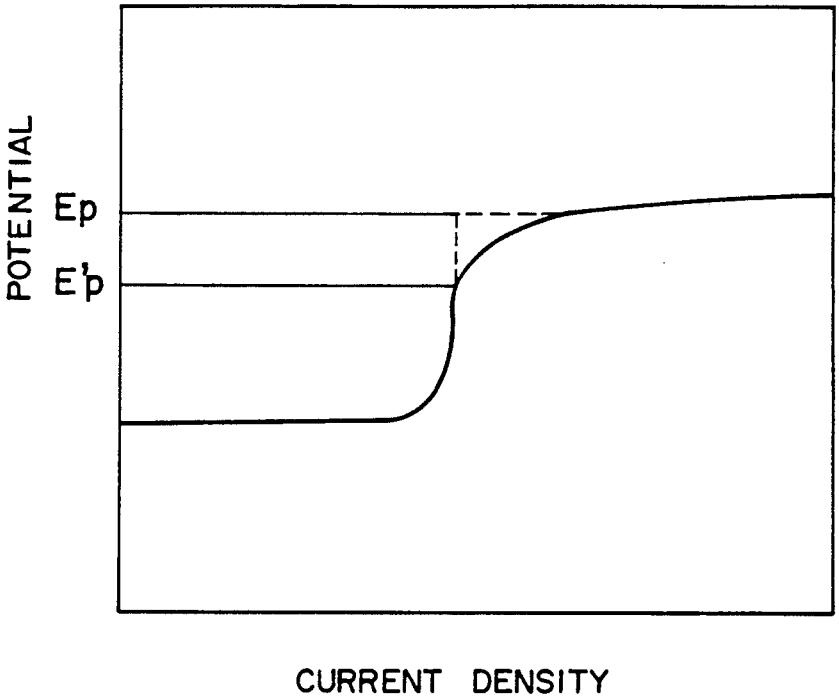
FIG. 3 is a graph showing an anodic polarization curve.
Figure 4:
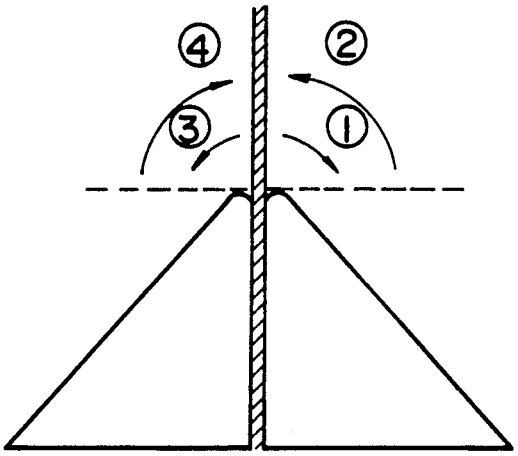
FIG. 4 is an illustration showing how to conduct a repeated bending test.

After the spontaneous potential of each test specimen became stable, polarization was measured at a scanning rate of 10 mV/minute. The shape of the anode polarization curve was influenced by alloying elements and thermal processing conditions. FIG. 3 shows a gentle curve in the vicinity of the pitting potential in which a pitting potential Ep on a high potential side, and a pitting potential E'p, on a low potential side (corresponding to the inflection point), were obtained by means of extrapolation. Corrosion resistance was evaluated in terms of the pitting potential difference (ΔEp) between Ep and E'p because a small pitting potential difference (ΔEp) means a small probability of intergranular corrosion.

Some test specimens were immersed in a 0.1 M-NaCl aqueous solution and electrolyzing was carried out for a period of 48 hours at a current density of 0.5 mA/cm$^2$. The corrosion state was examined for each tested specimen.

A repeated bending test was conducted by interposing each test specimen between and perpendicular to two triangular blocks with a round-shaped end of 1.0 mm radius and repeatedly bending at an angle of ±90°. In each bending cycle, the test specimens were bent in numerical order, i.e., the order of 1, 2, 3 and 4 indicated within circles and each value given in Table 2 is the average number of bending cycles until rupture for ten specimens.

Specimen Nos. 1 to 20, according to the present invention, had a tensile strength of at least 36.1 kgf/mm$^2$, a yield strength of at least 28 kgf/mm$^2$ and an elongation of at least 8%. Further, the test specimens showed earing percentages not exceeding 5.9% during the drawing operation, and a good bend ductility (at least 15 bending cycles). Also, the pitting potential differences (ΔEp) which were measured to judge corrosion resistance were at desirable levels not exceeding 8 mV vs SCE. FIG. 1 is a microphotograph showing the corrosion state which was observed for the cross section of Specimen No. 1 of the present invention. As will be noted from FIG. 1, it has been found that the corrosion of the invention specimens was slight.

Figure 2:
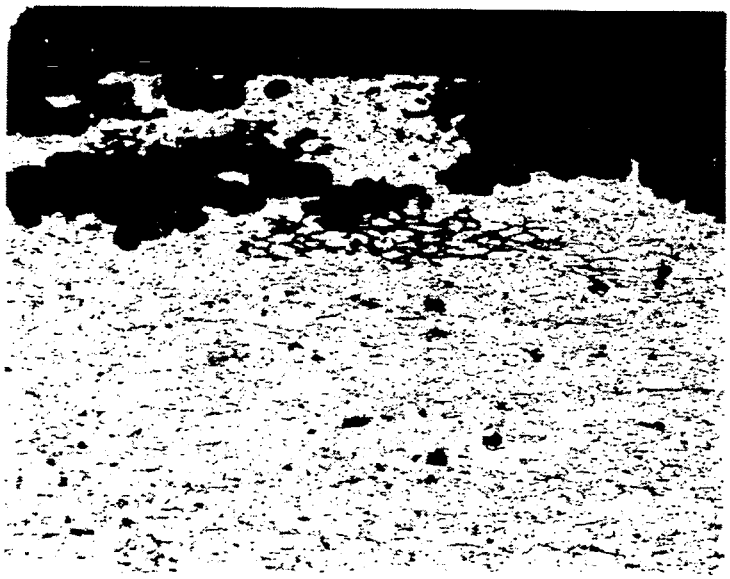
FIG. 2 is a microphotograph showing the microstructure of a comparative specimen similarly tested.

Comparative Specimen Nos. 21 to 26 all have compositions falling within the compositional range of the present invention, but they were all unsatisfactory. Specimen No. 21 showed an unacceptably high earing percentage of 7% and an insufficient bend ductility (number of bending cycles: 12.5), because the heating temperature in the intermediate annealing step was too low, namely, 300 ° C. Specimen No. 22 had a large ΔEp of 12 mV vs SCE due to an insufficient cooling rate of 0.1° C./sec in the intermediate annealing step and, thus, was poor in corrosion resistance. Specimen No. 23 showed a large ΔEp of 14 mV vs SCE and an inferior corrosion resistance, because the intermediate annealing was carried out on the coiled sheet material in a batch furnace, with a low heating rate and cooling rate. Specimen No. 24 showed an unfavorably large ΔEp of 15 mV vs SCE and an inferior corrosion resistance, because the intermediate annealing and stabilizing treatments were conducted on its coiled sheet material in a batch furnace, with low heating and cooling rates. Specimen No. 25 had a low tensile strength of 37.6 kgf/mm$^2$ and a low yield strength of 26.0 kgf/mm$^2$ due to the small cold rolling reduction of 40%. Specimen No. 26 showed a large ΔEp of 13 mV vs SCE and a poor corrosion resistance, due to the too high cooling temperature of 120° C. in the intermediate annealing step. Specimen Nos. 27 to 33 have a low Cu content of the order of 0.02%. Therefore, these specimens showed an insufficient bend ductility, a somewhat high pitting potential difference and a somewhat inferior corrosion resistance, although the intermediate annealing was carried out in accordance with the present invention. Further, with respect to the corrosion state, it was found that intergranular corrosion occurred, as shown in FIG. 2. Similarly, since the Mg content levels of Specimen Nos. 34 to 36 are as low as 3.2%. Therefore, the specimens showed a low tensile strength on the order of 30.6 to 32.9 kgf/mm$^2$ and a low yield strength on the order of 24.1 to 27.2 kgf/mm$^2$, although the intermediate annealing was practiced in accordance with the present invention.

EXAMPLE 2

Ingots having the compositions of Alloy Nos. 1 to 5 shown in Table 1 were homogenized, hot rolled and cold rolled to sheets in the same manner as set forth in Example 1. Then, the thus obtained sheets were subjected to intermediate annealing and finishing cold rolling operations under the processing conditions set forth in Table 3 below. A high polymer resin coating was applied onto each sheet by a roll coater and baked in a continuous annealing furnace under the conditions shown in Table 3. The coating and baking operations were effected under a tension of 1.5 kgf/mm$^2$. The thus processed sheets were each evaluated in the same manner as described in Example 1.

TABLE 3

| Specimen No. | 37 | 38 | 39 | 40 | 41 | 42 | 43 |
|---|---|---|---|---|---|---|---|
| Alloy No. | 1 | 1 | 1 | 2 | 3 | 4 | 5 |
| Intermediate annealing | | | | | | | |
| Heating rate (°C./sec) | 2 | 2 | 2 | 2 | 2 | 2 | 2 |
| Temp. (°C.) | 450 | 500 | 450 | 450 | 450 | 450 | 450 |
| Holding time (sec) | 30 | 30 | 30 | 30 | 30 | 30 | 30 |
| Cooling rate (°C./sec) | 40 | 40 | 100 | 40 | 40 | 40 | 40 |
| Cooling temp. (°C.) | 60 | 60 | 60 | 60 | 60 | 60 | 60 |
| Reduction*1 % | 65 | 65 | 65 | 65 | 65 | 65 | 65 |
| Baking treatment | | | | | | | |
| Heating rate (°C./sec) | 10 | 10 | 10 | 10 | 10 | 10 | 10 |
| Temp. (°C.) | 200 | 200 | 200 | 200 | 200 | 200 | 200 |
| Holding time (sec) | 0.33 | 0.33 | 0.33 | 0.33 | 0.33 | 0.33 | 0.33 |
| Cooling rate (°C./sec) | 50 | 50 | 50 | 50 | 50 | 50 | 50 |
| Cooling temp. (°C.) | 70 | 70 | 70 | 70 | 70 | 70 | 70 |
| Mechanical properties | | | | | | | |
| Tensile strength | 38.9 | 38.9 | 38.9 | 38.2 | 39.2 | 38.0 | 33.2 |

TABLE 3-continued

| Specimen No. | 37 | 38 | 39 | 40 | 41 | 42 | 43 |
|---|---|---|---|---|---|---|---|
| Alloy No. | 1 | 1 | 1 | 2 | 3 | 4 | 5 |
| (kgf/mm$^2$) | | | | | | | |
| Yield strength (kgf/mm$^2$) | 31.5 | 31.5 | 31.5 | 31.2 | 32.3 | 30.9 | 27.4 |
| Elongation (%) | 10 | 10 | 10 | 10 | 9 | 10 | 10 |
| Earing percentage 45° - 4 directions (%) | 3.5 | 3.5 | 3.5 | 3.5 | 3.5 | 3.5 | 3.4 |
| Bend ductility*2 | 16.8 | 16.9 | 16.8 | 16.6 | 17.1 | 14.7 | 16.8 |
| Pitting potential mV vs SCE | | | | | | | |
| Ep | −670 | −670 | −670 | −672 | −662 | −673 | −665 |
| E'p | −673 | −673 | −673 | −677 | −665 | −683 | −668 |
| Δ Ep | 3 | 3 | 3 | 5 | 3 | 10 | 3 |

In Table 3;
*1: Reduction amounts of finishing cold rolling,
*2: Number of bending cycles until rupture occurred
Specimen Nos. 37-41: Examples of the present invention
Specimen Nos. 42-43: Comparative Examples Specimen Nos. 37 to 41 having compositions falling within the range of the present invention were subjected to intermediate annealing and finishing cold rolling operations in accordance with the present invention followed by the coating and baking treatments set forth in Table 3. The specimens had a tensile strength of at least 38.2 kgf/mm$^2$, a yield strength of at least 31.2 kgf/mm$^2$ and good bend ductility (number of bending cycles: not less than 16.6). Also, these specimens had a good pitting potential difference ΔEp, which was used to judge corrosion resistance, on the order of 5 mV vs SCE or less.

Comparative Specimen No. 42 had a low level of bend ductility, a somewhat high pitting potential difference and an insufficient corrosion resistance, due to the insufficient Cu content of 0.02%. Comparative Specimen No. 43 had a low tensile strength of 33.2 kgf/mm$^2$ and a low yield strength of 27.4 kgf/mm$^2$, due to the insufficient Mg content of 3.2%.

As described above, the work-hardened aluminum alloy sheets according to the present invention have superior intergranular corrosion resistance and bend ductility properties together with high levels of strength and formability irrespective of the processing conditions of the stabilizing treatments. Such advantageous properties are provided by the addition of Cu to Al-Mg alloys and by conducting a final intermediate annealing under the specified conditions using a continuous annealing furnace. The hardened aluminum alloy sheets of the present invention are highly suited for use in applications such as easy-open can end stock.

What is claimed is:

1. In a method of producing a hardened aluminum alloy sheet by casting an aluminum alloy containing 4.0 to 6.0% Mg in a conventional manner, said method comprising a homogenizing step, a hot rolling step, multiple cold rolling steps, at least one intermediate annealing step and a stablizing treatment step, the improvement comprises: said aluminum alloy being provided as an Al-Mg-Cu alloy containing 0.05 to 0.50% Cu in addition to Mg; and said Al-Mg-Cu alloy being subjected to (1) a final intermediate annealing step comprising heating to temperatures of 350° to 500° C. and rapid cooling to temperatures of 70° C. or less at a cooling rate of 1° C./sec or more and (2) a finishing cold rolling step with a reduction of at least 50%, followed by said stabilizing treatment step, thereby providing a hardened aluminum alloy sheet having a superior corrosion resistance.

2. In a method of producing a hardened aluminum alloy sheet by casting an aluminum alloy containing 4.0 to 6.0% Mg in a conventional manner, said method comprising a homogenizing step, a hot rolling step, multiple cold rolling steps, at least one intermediate annealing step and a stabilizing treatment step, the improvement comprises: said aluminum alloy being provided as an Al-Mg-Cu alloy containing 0.05 to 0.50% Cu in addition to Mg; and said Al-Mg-Cu alloy being subjected to (1) a final intermediate annealing step comprising heating to temperatures of 350° to 500° C. and rapid cooling to temperatures of 70° C. or less at a cooling rate of 1° C./sec or more; (2) a finishing cold rolling step with a reduction of at least 50%; and (3) coating and baking operations under application of tension, thereby providing a hardened aluminum alloy sheet having a superior corrosion resistance.

* * * * *

UNITED STATES PATENT AND TRADEMARK OFFICE

CERTIFICATE OF CORRECTION

PATENT NO. : 5 062 901

DATED : November 5, 1991

INVENTOR(S) : Hiroki TANAKA et al

It is certified that error appears in the above-identified patent and that said Letters Patent is hereby corrected as shown below:

Title page, in the Abstract, line 4; change "conventional including," to ---conventional manner, including---.

Signed and Sealed this

Twenty-fifth Day of May, 1993

*Attest:*

*Attesting Officer*

Michael K. Kirk

MICHAEL K. KIRK

*Acting Commissioner of Patents and Trademarks*